US007128954B2

(12) United States Patent
Tsai

(10) Patent No.: US 7,128,954 B2
(45) Date of Patent: Oct. 31, 2006

(54) TRUNK JOINT FOR AN ARTIFICIAL TREE

(76) Inventor: Yuan-Hui Tsai, 56, Tzyh-Li Rd. 1, Nankan Industrial Dis., Nantou (TW) 540

( * ) Notice: Subject to any disclaimer, the term of this patent is extended or adjusted under 35 U.S.C. 154(b) by 5 days.

(21) Appl. No.: 10/990,505

(22) Filed: Nov. 18, 2004

(65) Prior Publication Data

US 2006/0105118 A1 May 18, 2006

(51) Int. Cl.
*A01N 3/00* (2006.01)

(52) U.S. Cl. ..... 428/17

(58) Field of Classification Search ..... 428/7, 428/10, 12, 18, 19, 23, 27
See application file for complete search history.

(56) References Cited

U.S. PATENT DOCUMENTS 5,015,510 A * 5/1991 Smith ..... 428/18
5,054,622 A * 10/1991 Lee ..... 211/2
6,116,563 A * 9/2000 Tsai ..... 248/512
2004/0191431 A1* 9/2004 Lai ..... 428/18

* cited by examiner

*Primary Examiner*—Jennifer C. McNeil
*Assistant Examiner*—Gordon R. Baldwin
(74) *Attorney, Agent, or Firm*—Leong C. Lei

(57) ABSTRACT

Disclosed is a trunk joint for an artificial tree which comprises a tube member having a first diameter. A collar having a base extends from the tube member and having a second diameter different to the first diameter and the base defines at least a supporting opening through a wall thereof. A positioning disk is arranged in the collar and having an aperture of a third diameter substantially equal to the first diameter for receiving a trunk therein. The aperture has an inner rim defining at least one locking notch corresponding to the supporting opening through the wall of the collar.

5 Claims, 8 Drawing Sheets

TRUNK JOINT FOR AN ARTIFICIAL TREE

FIELD OF THE INVENTION

The present invention relates to a trunk joint, and more particularly to a trunk joint for an artificial tree in which artificial branches can be properly positioned radially along the perimeter of the trunk joint so as to make the artificial tree stands still and beautifully.

DESCRIPTION OF PRIOR ART

Generally, an artificial tree, such as Christmas includes a trunk from which a plurality of branches are stemmed from, and a stand on which the trunk and the branches are firmly and securely supported. The assembled artificial tree is further decorated with light strings, and all kinds of decoration. In order to attach the branches onto the trunk, a plurality of branch joints is used to as to assemble the branches. The prior art branch joint is made from plastic molding or sheet metal having pedestal shape, such as shown in FIG. 1. However, the branch joint made from plastic molding or sheet metal have very poor tolerance which provides poor support to the branches stemmed therefrom. On the other hand, those branch joint tends to be damaged when portion of the sheet metal pedestal is damaged. Furthermore, the shape edges of the pedestal may easily get users injured.

U.S. Pat. No. 5,015,510 issued to Smith discloses an apparatus for mounting artificial tree branches to an artificial tree trunk. As disclosed in the abstract, a series of bracket guideways are adapted for pivotal engagement with a plurality of branch members for movement of each member between stowed and operative positions. Each branch engages a guideway notch which suspends the branch in an operative position radially from the tree trunk. As each branch member moves between stowed and operative positions, a guideway slot receives one leg of a branch so as to enable its elbow to pass through the guideway. Upon moving the branches into a stowed or an operative position, each branch member engages a guideway slot or notch, respectively, restricting radial rotation of the branch.

U.S. Pat. No. 6,116,563 issued to the Applicant discloses another bracket joint for the use of the artificial tree, i.e. the Christmas tree. According to the disclosure, A branch joint for use with a christmas tree to connect a plurality of additional branches to trunk of the christmas tree, are designed to an umbrella-shaped body. A plurality of top and bottom ellipses respectively distributed on the top and bottom circumference of said body. A plurality of recesses form on a top edge of said body. Meanwhile, the additional branches are capable of being respectively inserted into said top ellipses, through the bottom ellipses, to be inward bent at a specific angle then for retaining a distal end of each branch within the corresponding recess whereby the branches and the umbrella-shaped body are retained together in a more natural, simple and useful manner.

As clearly seen from the disclosure of the Smith '510 and Tsai '563 patents, it can be easily found that all the branches are loosely arranged along the joint. Accordingly, it is difficult to create an artificial tree with predetermined shape and outlook. Specially, each of the branches extends from the joint which is spatially apart from the trunk.

SUMMARY OF THE INVENTION

It is the objective of the present invention to provide a trunk joint in which when a branch is mounted thereon, creating a phenomena such that the branch extends substantially from the trunk.

In order to achieve to the object set forth, a trunk joint in accordance with the present invention includes a tube member having a first diameter. A collar extends from the tube member and having a second diameter different to the first diameter and the collar defining at least an opening through a wall thereof. A positioning disk is arranged in the collar and having an aperture of a third diameter substantially equal to the first diameter for receiving a trunk therein. The aperture has an inner rim defining at least one first notch corresponding to the opening through the wall of the collar.

According to one aspect of the present invention, once a trunk is inserted into the tube through the aperture of the positioning disk, branches assembled on the trunk joint will be properly locked within the first notch.

DETAILED DESCRIPTION OF PREFERRABLE EMBODIMENT

Figure 2:
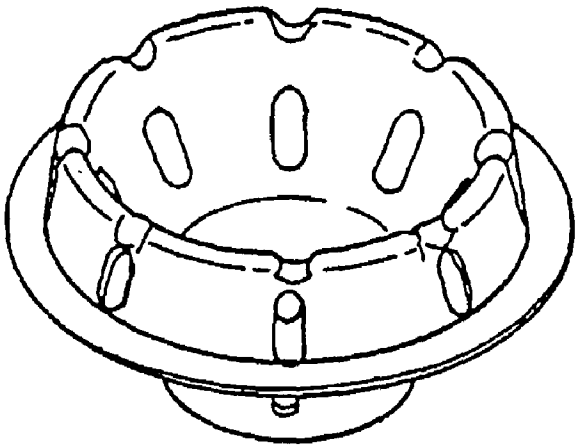
Fig 2 Prior Art
FIG. 2 is an illustration of a bracket joint disclosed in U.S. Pat. No. 6,116,563 which was issued to the applicant of the present invention.
Figure 1:
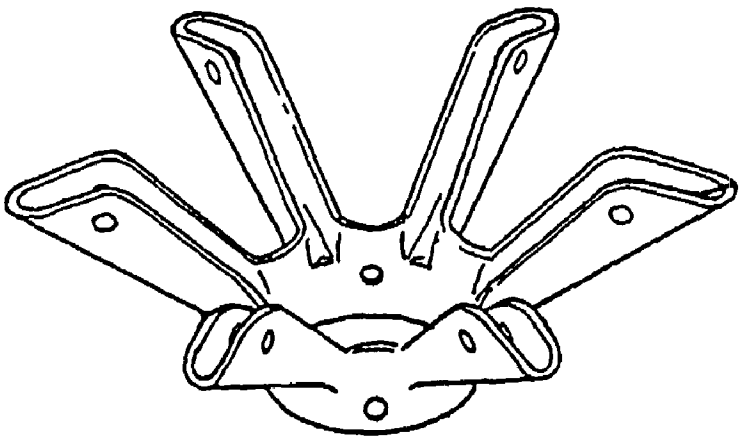
Fig 1 Prior Art
FIG. 1 is a conventional bracket joint.
Figure 3A:
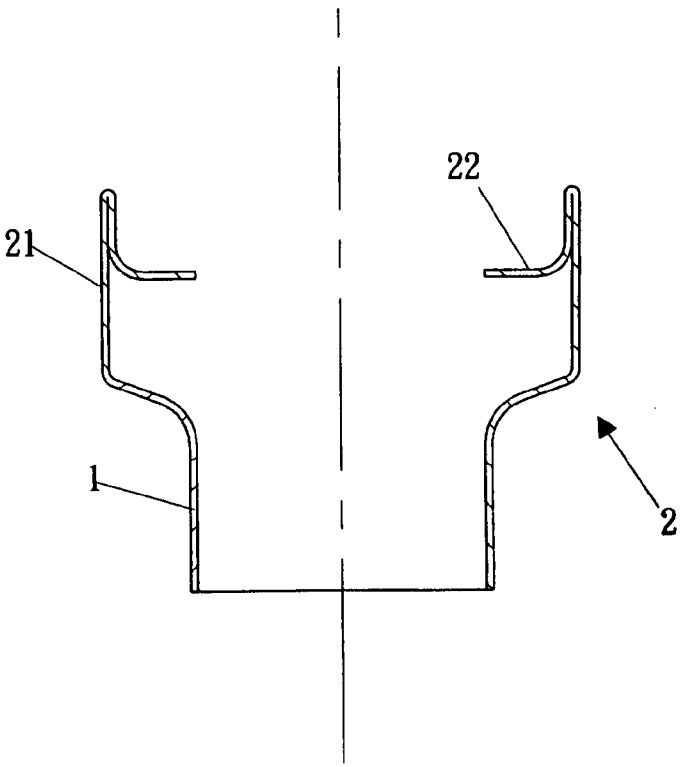
FIG. 3A is a cross sectional view of FIG. 3.
Figure 3:
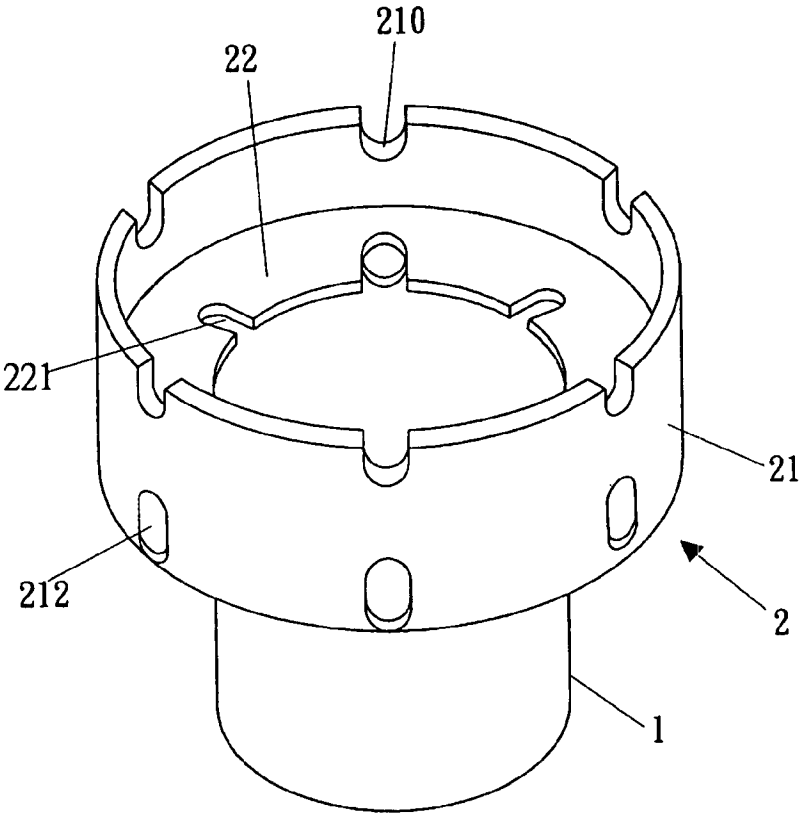
FIG. 3 is a perspective view of a first embodiment of a trunk joint in accordance with the present invention.

Referring to FIGS. 3 and 3A, a perspective view and cross section view of a first embodiment of a trunk joint for an artificial tree in accordance with the present invention. The trunk joint generally includes a tube member 1 on which a collar 2 extends. The collar 2 includes a base 21 and a positioning disk 22 arranged inside of the base 21. The base 21 defines a plurality of locating notches 210 for securely positioning end portion 31 of branch 3 along an upper rim. The base 21 further defines a plurality of supporting opening 212 in which the end portion 31 of the branch 3 extends through. Those supporting opening 212 are located under the positioning disk 22. On the other hand, the positioning disk 22 is further provided with locking notches 221 along its inner rim.

According to the present invention, the positioning disk 22 has an aperture having a diameter with is substantially equal to an inner diameter of the tube member 1. The diameter is specially dimensioned so as to properly receive a trunk therethrough.

As it can be really seen from the Figures, the positioning disk 22 has an annual configuration, and the locking notches 221 are arranged along its inner rim such that the locking notches 221 each is aligned to the corresponding supporting opening 212.

Figure 4A:
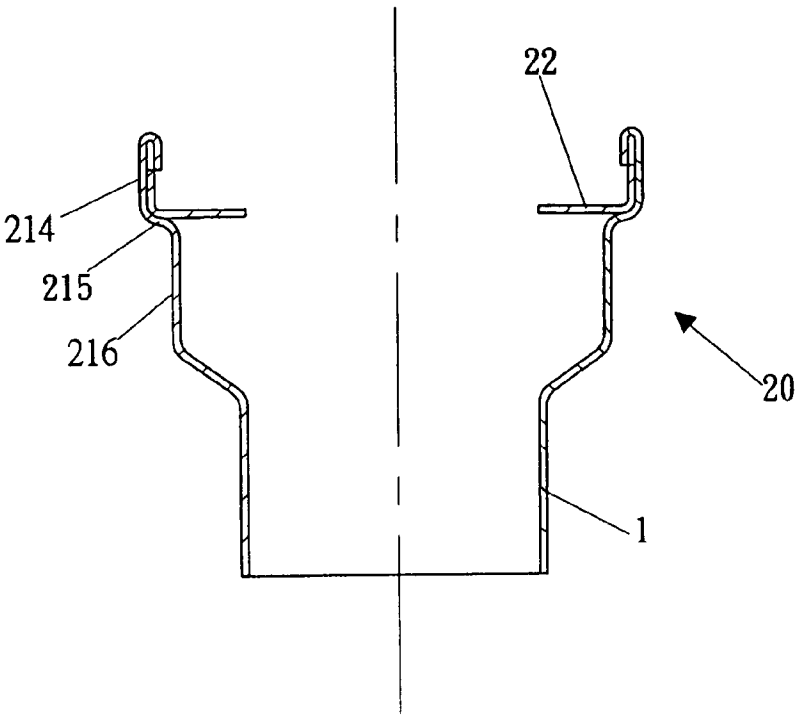
FIG. 4A is a cross sectional view of FIG. 4.
Figure 4:
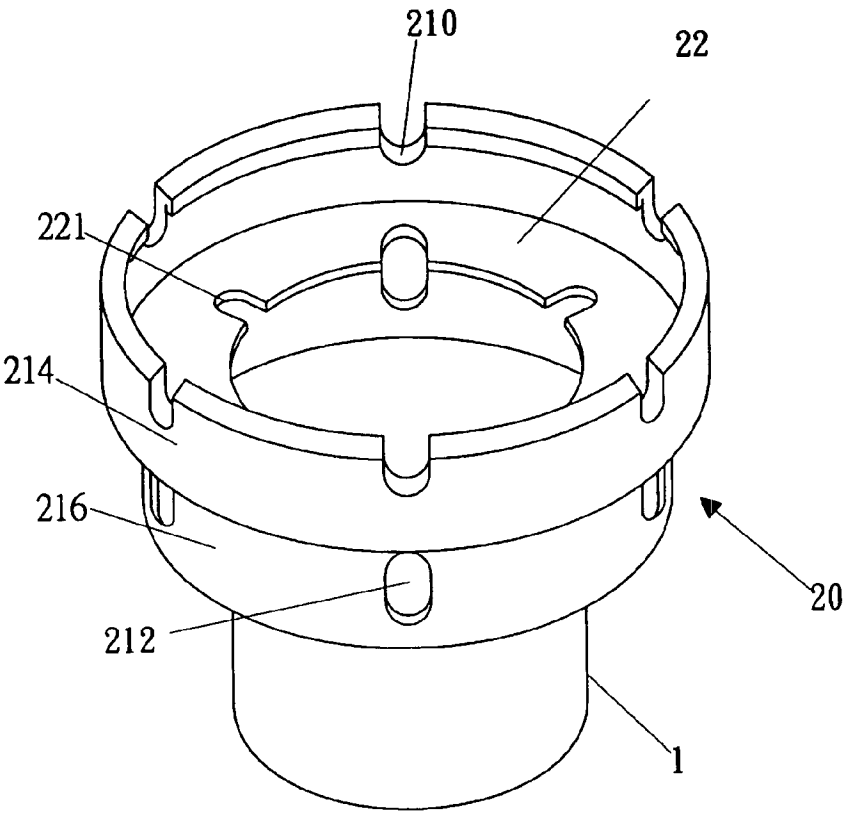
FIG. 4 is a perspective view of a second embodiment of a trunk joint in accordance with the present invention.
Figure 4B:
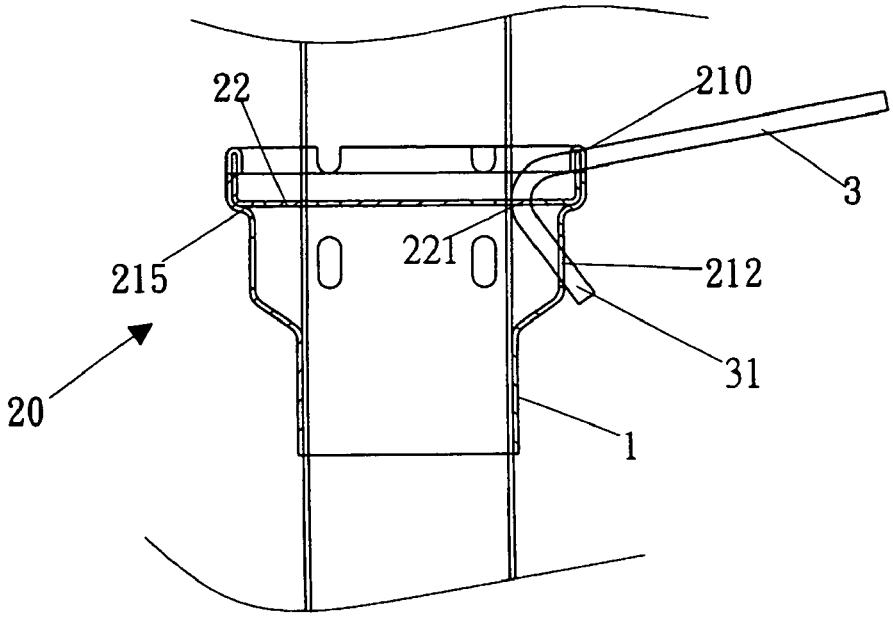
FIG. 4B is an illustration showing a branch is directed upward.
Figure 4C:
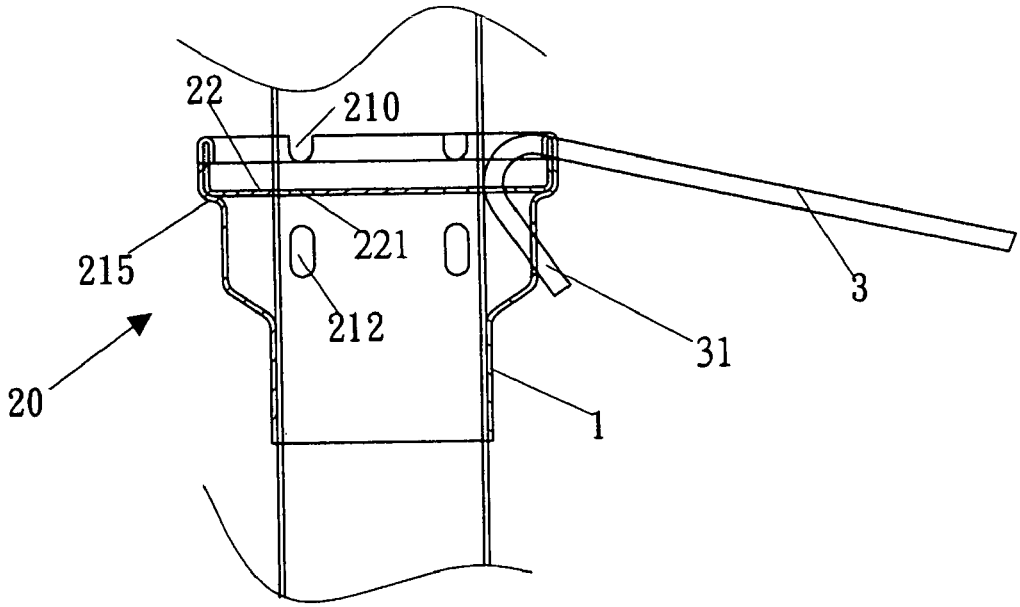
FIG. 4C is another illustration showing a branch is directed downward.
Figure 5A:
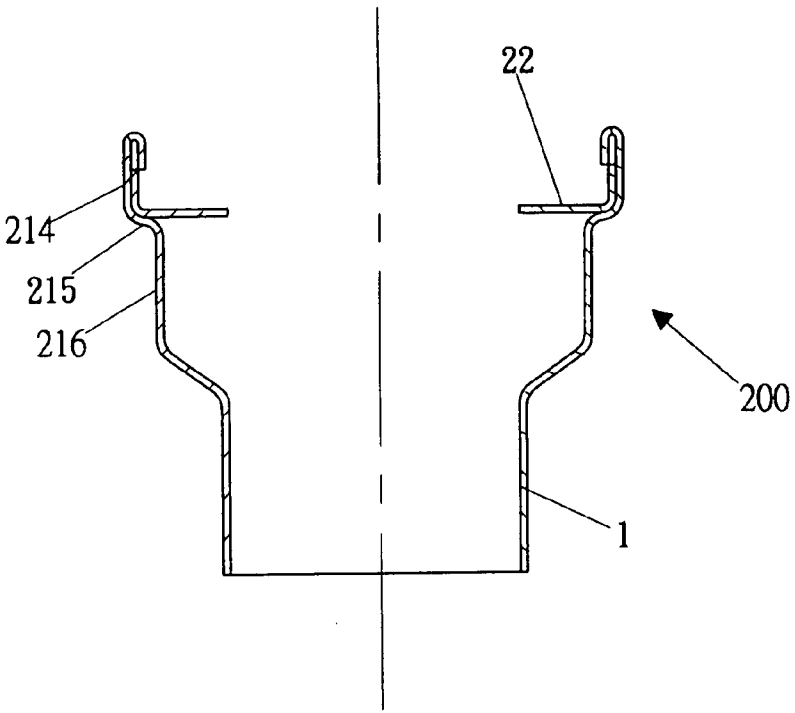
FIG. 5A is a cross sectional view of FIG. 5.
Figure 5:
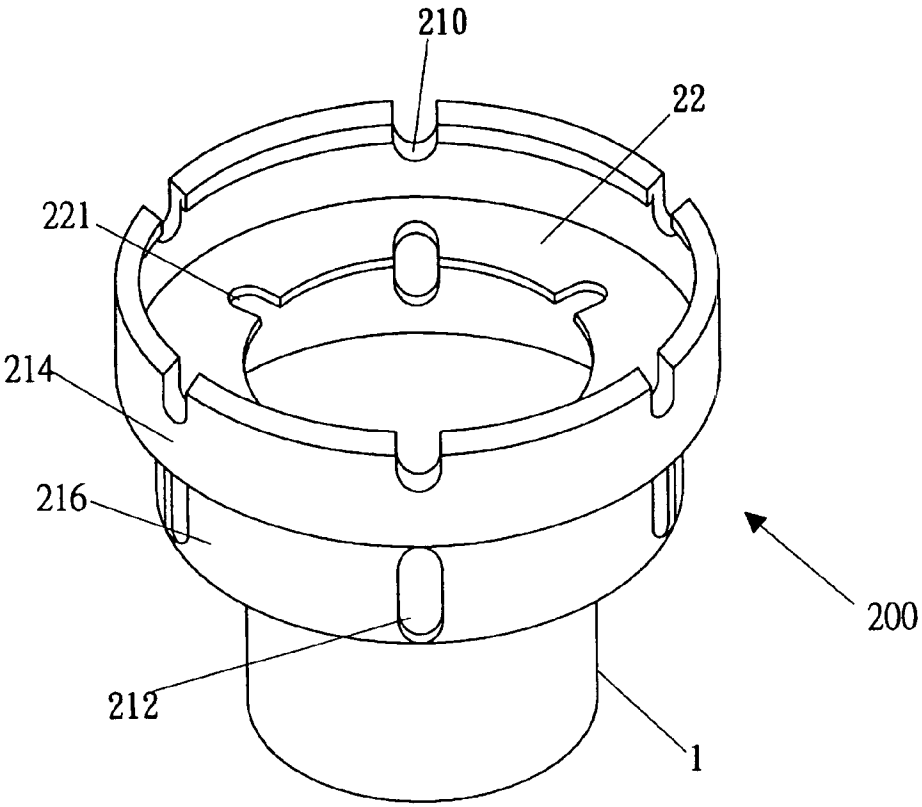
FIG. 5 is a perspective view of a third embodiment of a trunk joint in accordance with the present invention.

Referring to FIGS. 4 and 4A, as well as FIGS. 5 and 5A, each discloses a perspective view and cross sectional view of a trunk joint in accordance with second and third embodiments in accordance with the present invention. There is some differences between the first, second and third embodiments.

As clearly shown in FIGS. 4 and 4A, as well as FIGS. 5 and 5A, the collar 20~200 is configured by a first tubular base 214 and a second tubular base 216 jointed by a transition 215. The first tubular base 214 defines a plurality of locating notches 210, while the second tubular base 216 defines a plurality of supporting openings 212 in align with the locating notches 210.

In the second and third embodiments, an upper rim of the first tubular base 214 includes a bend which jointly defining a space with the transition 215. As such, a positioning disk 22 is properly snapped between the space defined by the bend and the transition 215. Again, the positioning disk 22 is provided with a plurality of locking notches 221 corresponding to the locating notches 210 and the supporting openings 212.

As compared with the prior art, the present invention features that the branches can be easily and securely assembled. Since the branches 3 are firmly secured by the trunk joint, the branches 3 can be effectively prevented from swinging or moving. As a result, the customer can use it in a more safe way. In addition, the branch joint is simply configured, and therefore it can be easily manufactured.

Referring to FIGS. 3 and 3A, a perspective view and cross section view of the first embodiment of a trunk joint for an artificial tree in accordance with the present invention. The trunk joint generally includes a tube member 1 on which a collar 2 extends. Even the first embodiment is featured as a tubular configuration, it should be noted that any other configuration can be used as well. The collar 2 includes a base 21 and a positioning disk 22 arranged inside of the base 21. The base 21 defines a plurality of locating notches 210 for securely positioning end portion 31 of branch 3 along an upper rim. The locating notches 210 are arranged in equal distance and the number of them can be readily selected according to actual requirements. For example, there can be two notches, or sixteen notches. The base 21 further defines a plurality of supporting opening 212 in which the end portion 31 of the branch 3 extends through. Those supporting opening 212 are located right under the positioning disk 22. On the other hand, the positioning disk 22 is further provided with locking notches 221 along its inner rim. The locking notches 221 can be also arranged for other shape, such as a polygons or ellipse or a circular hole etc. As it can be seen from the Figures, the supporting opening 212, the locating notch 210 and the locking notch 221 are jointly define a triangle, as such the end portion 31 of the branch 3 is firmly supported in three points.

Figure 3B:
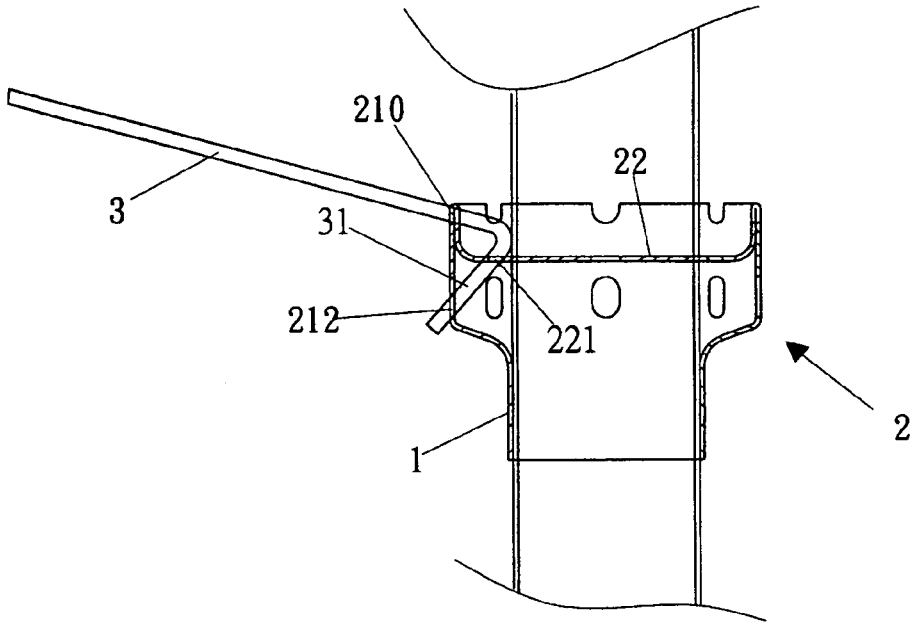
FIG. 3B is an illustration showing a branch is directed upward.
Figure 3C:
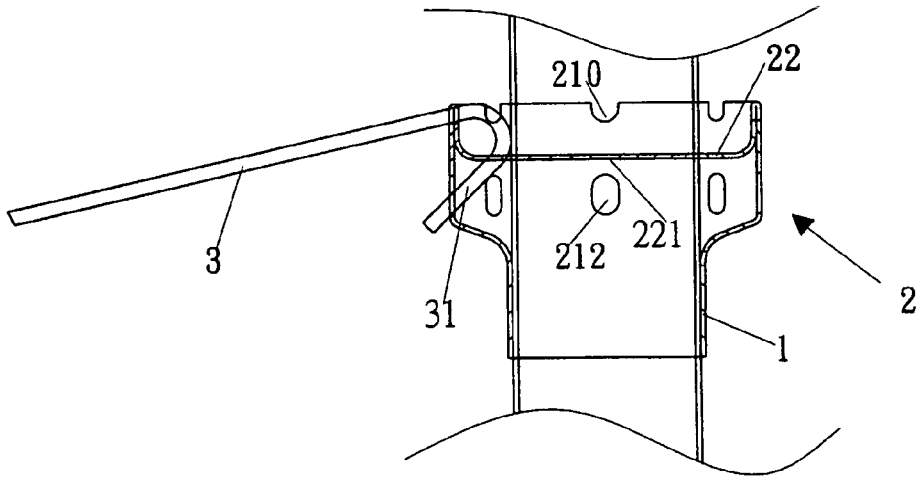
FIG. 3C is another illustration showing a branch is directed downward.

Referring to FIGS. 3B and 3C, the branch 3 when it is assembled to the trunk joint, it can be directed upward or downward, as shown respectively in FIGS. 3B and 3C. In assembly, the end portion 31 of the branch 3 can be bent so as to form a L-shaped or U-shaped configuration. The end portion 31 is firstly inserted through the supporting opening 212 through the locking notch 221 of the positioning disk 22. After the end portion 31 is properly located within the positioning opening 212, then the end portion 31 can securely rest onto the locating notch 210. As such, the branch 3 is securely positioned within the trunk joint as which is supported in triangularly in three points. Accordingly, the branches assembled through the trunk joint will not easily fallen apart. The tube member 1 can be punched with recess or put a nail through when the branch is enveloped onto a trunk. The assembly can be easily opened or packed when not in use, and easily assembled.

As clearly shown in FIGS. 4 and 4A, as well as FIGS. 5 and 5A, the collar 20~200 is configured by a first tubular base 214 and a second tubular base 216 jointed by a transition 215. The first tubular base 214 defines a plurality of locating notches 210, while the second tubular base 216 defines a plurality of supporting openings 212 in align with the locating notches 210.

Specially, an upper rim of the first tubular base 214 includes a bend which jointly defining a space with the transition 215. As such, a positioning disk 22 is properly snapped between the space defined by the bend and the transition 215. Again, the positioning disk 22 is provided with a plurality of locking notches 221 corresponding to the locating notches 210 and the supporting openings 212 which has an elongate shape. The assembly of the branch 3 to the trunk joint is similar to the first embodiment discussed above, no further description is given here below.

Figure 5B:
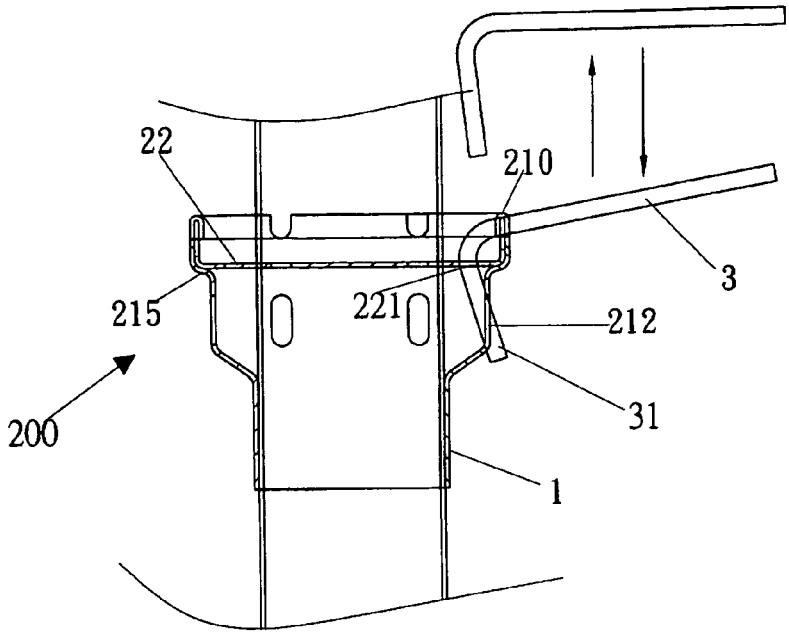
FIG. 5B is an illustration showing a branch is directed upward.
Figure 5C:
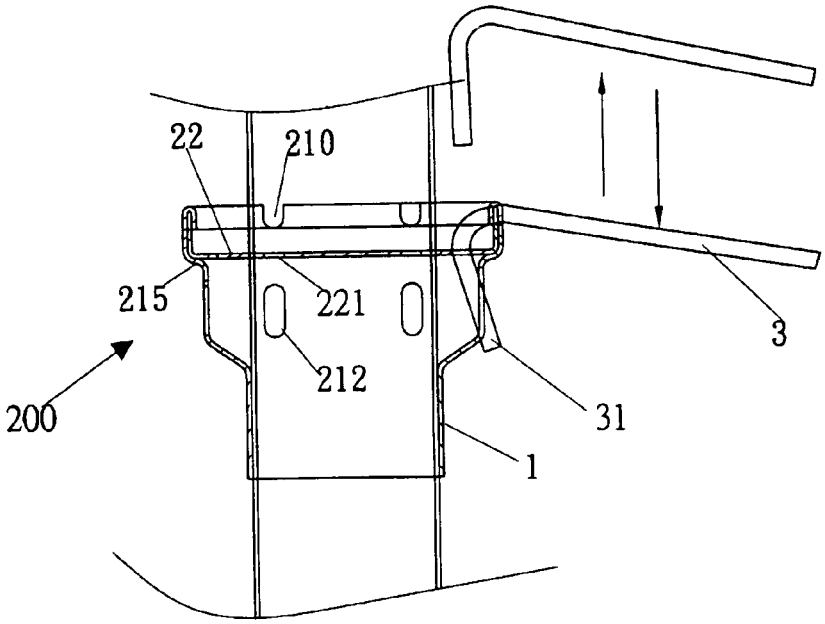
FIG. 5C is another illustration showing a branch is directed downward.
Figure 6:
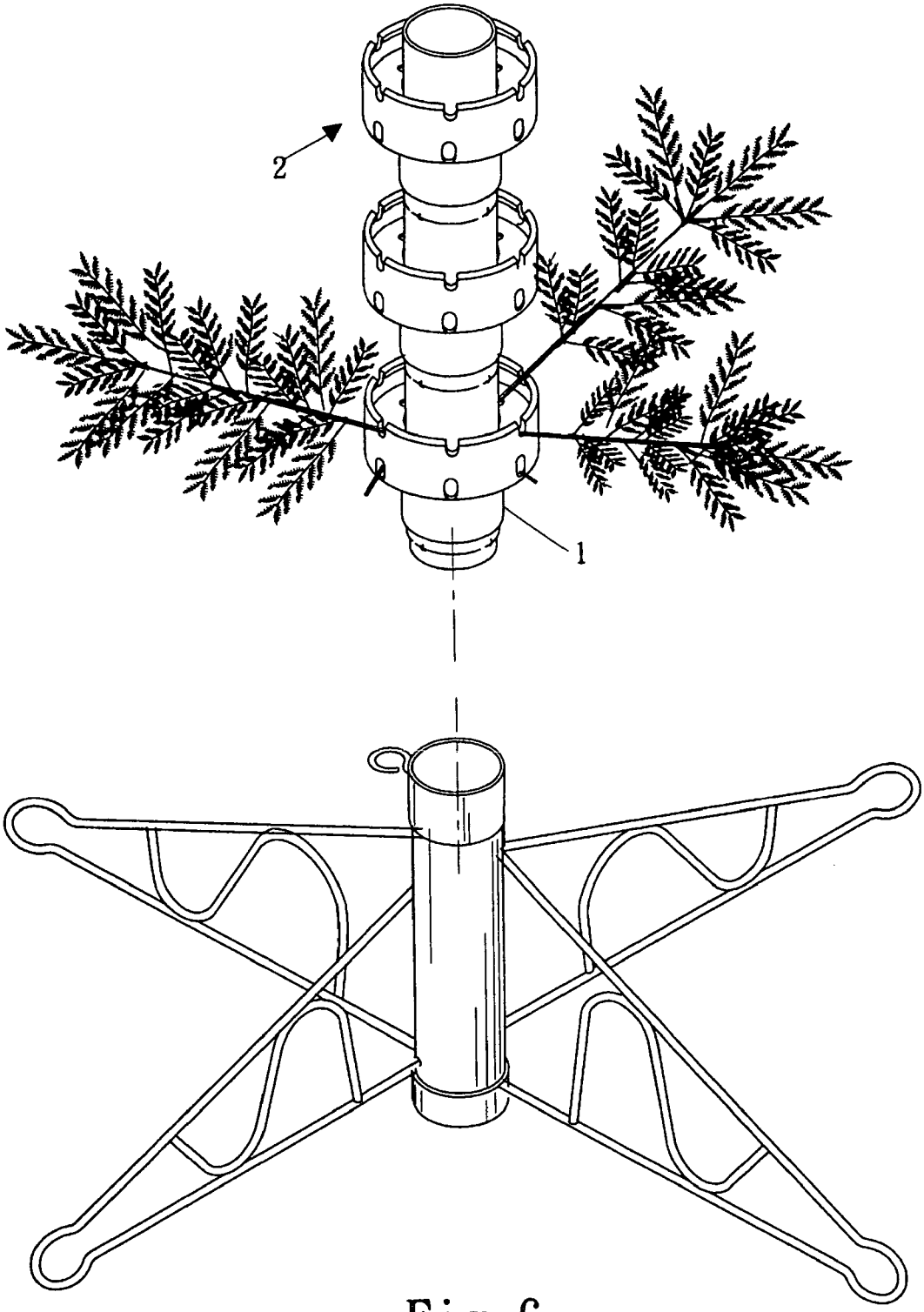
FIG. 6 is a perspective view of first embodiment showing the trunk joint positioned part of the branches when assembled to use.

The difference between the second and third embodiments is that the elongate supporting opening 212 extends to the bottom edge of the second tubular base 216. The longer the supporting opening 212, the larger the angle between the end portion 31, as shown in FIGS. 5B and 5C. The angle can even be 90 degrees. By this arrangement, the diameter of the tubular member can be effectively reduced.

I claim:

1. A trunk joint for an artificial tree, comprising:

a tube member having a first diameter;

a collar having a base extending from the tube member and having a second diameter different to the first diameter, the base defining at least a supporting opening trough a wall thereof, the collar having a top rim defining a locating notch corresponding to each supporting opening; and a positioning disk arranged in the collar and having an aperture of a third diameter substantially equal to the first diameter for receiving a trunk therein, the aperture having an inner rim defining at least one locking notch corresponding to the supporting opening through the wall of the collar;

wherein each locking notch, and the corresponding supporting opening and locating notch form a planar three point spatial relationship that is adapted to firmly support a branch.

2. The trunk joint as recited in claim 1, wherein the tube member, the collar and the positioning disk are integrally formed.

3. The trunk joint as recited in claim 1, wherein there are six sets of supporting openings, locking and locating notches for positioning at least six branches thereon.

4. The trunk joint as recited in claim 1, wherein the collar comprises a first tubular base and a second tubular base jointed to each other and wherein the first tubular base defines a plurality of locating notches, while the second tubular base defines a plurality of supporting openings in alignment with the locating notches respectively.

5. The trunk joint as recited in claim 4, wherein the supporting opening is an elongated opening.

* * * * *